US006474778B1

(12) United States Patent
Koitabashi et al.

(10) Patent No.: US 6,474,778 B1
(45) Date of Patent: Nov. 5, 2002

(54) INK JET PRINTING APPARATUS AND INK JET PRINTING METHOD

(75) Inventors: Noribumi Koitabashi, Yokohama; Hitoshi Tsuboi, Tokyo, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/610,854

(22) Filed: Jul. 5, 2000

(30) Foreign Application Priority Data

Jul. 5, 1999 (JP) ..... 11-190578

(51) Int. Cl.[7] ..... B41J 2/21
(52) U.S. Cl. ..... 347/43; 347/98; 347/100
(58) Field of Search ..... 347/15, 40, 41, 347/43, 96, 98, 100, 95

(56) References Cited

U.S. PATENT DOCUMENTS 5,568,169 A * 10/1996 Dudek et al. ..... 347/43
5,933,164 A * 8/1999 Sato et al. ..... 347/43
6,062,674 A * 5/2000 Inui et al. ..... 347/43
6,120,141 A * 9/2000 Tajika et al. ..... 347/43
6,123,411 A * 9/2000 Inui et al. ..... 347/43
6,158,834 A * 12/2000 Kato et al. ..... 347/43

* cited by examiner

*Primary Examiner*—Lamson D. Nguyen
(74) *Attorney, Agent, or Firm*—Fitzpatrick, Cella, Harper & Scinto

(57) ABSTRACT

In an ink jet printing apparatus, black characters or the like can be printed with high density and little feathering as well as with high fixing capability, and images can be printed which are subject to little bleeding between a boundary between a black image, particularly a black character, and a color image. More specifically, a processing liquid is ejected onto a black ink on a dot-on-dot basis, and in an area onto which color inks are ejected, the processing liquid is not applied to pixels in eight neighborhoods of pixels onto which the black ink is ejected. Thus, no processing liquid is present at the boundaries between a black area and a color area, then a reactant between the black ink and the processing liquid or the like is prevented from flowing out to the peripheries of the boundaries, thereby reducing bleeding at the boundaries between the color image and the black image, when the color inks are applied to the peripheries.

32 Claims, 12 Drawing Sheets

INK JET PRINTING APPARATUS AND INK JET PRINTING METHOD

This application is based on Patent Application No. 11-190578 (1999) filed Jul. 5, 1999 in Japan, the content of which is incorporated hereinto by reference.

BACKGROUND OF THE INVENTION

1. Field of the Invention

The present invention relates to an ink jet printing apparatus and an ink jet printing method, and particularly to an ink jet printing apparatus and an ink jet printing method for performing printing using a processing liquid that makes inks insoluble.

2. Description of the Prior Art

Ink jet printing apparatuses, which have advantages such as their capability of simple printing on various printing mediums, are enjoying more and more applications due to their improved print quality. Ink jet printers are not only used personally but also in offices in order to output various types of information, for example. The ink jet printing apparatuses are what are also used as printout apparatuses in facsimile machines, copy machines, and word processors or the like.

Thus, the ink jet printing apparatuses are further desired to provide a higher image quality. Specifically, it is desirable that printed characters such as black letters have high density and have sharp edges without feathering, that is, bleeding in a form of whiskers. In addition, in printing color images, bleeding is desirably prevented at boundaries between colors.

Some conventional methods, which increase the density (for example, OD: optical density) of black characters and form an image with sharp edges, use ink as a black (Bk) ink, what is called a remaining upper part-type ink, which permeates through a plain paper at a relatively low speed so that a coloring material remain at an upper part (shallower part) of a printing medium.

A problem with the use of such an remaining upper part-type ink of Bk, however, is that due to its insufficient fixing capability (permeability), a relatively long time is required to eject printed paper and obtain a printed product, especially to fix the printed image when solid images which have a particularly high duty are printed.

On the other hand, highly permeable inks have generally been used in order to prevent ink from bleeding at boundaries between colors in color images. In this case, however, when the Bk ink is also highly permeable, it is disadvantageously impossible to increase the density of black characters as described above or other problems may result.

In order to solve this problem, a remaining upper part-type Bk ink of lower permeability is used, while the other color inks are highly permeable. Additionally, the bleeding at the boundaries is prevented by allowing the Bk and color inks to be ejected in accordance with a fixed or more amount of time difference, or for the boundaries, by using a process black obtained through compounding from color inks. In this case, however, printing black characters has insufficient fixing capability. Thus, this method does not enable fast printing, as desired particularly in offices.

In addition, a known means for improving, in particular, the fixing capability provides heaters along a paper feed path to evaporate moisture from the inks in order to promote fixation. This configuration enables faster fixing which contributes to faster printing and reduction of feathering and bleeding at the boundaries.

As is apparent from the above description, it is relatively difficult for the conventional techniques to print high-grade black characters or the like and perform printing without bleeding at the boundaries between colors, with a relatively high speed.

More specifically, a mere change in Bk ink permeability does not allow these problems to be simultaneously solved, particularly because there is a tradeoff relationship between the printed character grade such as the density and the fixing capability. This, in turn, can not provide a sufficient solution to the problem of bleeding at the boundaries.

In particular, the method of allowing the inks to be ejected at different points of time or using the process black as described above has difficulties in realizing fast printing. In addition, the method of using the heaters for fixing is not practical because more thermal energy is required to achieve fast printing.

The assignee of the present application has proposed use of a processing liquid for making color materials in ink insoluble, in order to improve the above-described black character grade or to improve color-developing capability. Such processing liquid is originally used to improve water resistance of printed images, but for example, can be used as follows. The processing liquid is ejected before ejection of the ink so that the processing liquid reacts with the ink ejected after and much color material in the ink remains on a surface of the paper, thereby increasing the density and the color-developing capability and preventing feathering from occurring. Additionally, a proposal has been also made to adjust the permeability of the processing liquid to improve the fixing capability of the printed images.

The use of the processing liquid together with the ink as described above is effective in improving the print grade or the fixing capability, but has not successfully prevented the bleeding at the boundaries between the Bk ink and the color ink.

SUMMARY OF THE INVENTION

The object of the present invention is to provide an ink jet printing apparatus and an ink jet printing method that allow printing of black characters with a high speed, high density and little feathering to be realized while ensuring water resistance of a printed image and that allow images to be printed with little bleeding at boundaries between colors.

In a first aspect of the present invention, there is provided an ink jet printing method of performing printing by applying to a printing medium, an ink and a processing liquid for making a coloring material in the ink insoluble, the method comprising the step of:

applying the processing liquid to respective areas of the printing medium to which a black ink containing a black coloring material and a color ink are applied, respectively, wherein the processing liquids is applied for each of the respective areas so that the respective processing liquids do not come in contact with one another on the printing medium.

In a second aspect of the present invention, there is provided an ink jet printing apparatus for performing printing by applying to a printing medium, an ink and a processing liquid for making a coloring material in the ink insoluble, the apparatus comprising:

means for applying the processing liquid to respective areas of the printing medium to which a black ink containing a black coloring material and a color ink are applied, respectively, the respective areas having a boundary between the areas, wherein the processing liquids is applied for each of the respective areas so that the respective processing liquids do not come in contact with one another on the printing medium.

With the above configuration, in the case of using the processing liquid together with a black and color inks to print an image, in which an image area printed with the black ink and an image area printed with the color ink are mixed, an application of the inks and the processing liquid is controlled so that the respective processing liquid applied to each of the areas of black and inks will not be connected with each other on the printing medium. Consequently, the respective processing liquid can be present within the boundary between the area of the black ink and the area of the color inks, whereby reactants between the Bk ink and the processing liquid are prevented from flowing out to the area of color inks. As a result of this, reducing the bleeding at the boundaries between the area of black ink and the area of color inks can be realized.

The above and other objects, features and advantages of the present invention will become more apparent from the following description of embodiments thereof taken in conjunction with the accompanying drawings.

DESCRIPTION OF THE PREFERRED EMBODIMENT

Embodiments of the present invention will be described below in detail with reference to accompanied drawings.

In processes of obtaining the embodiments of the present invention, the inventors of the present invention carried out following examinations and experiments.

Figure 1:
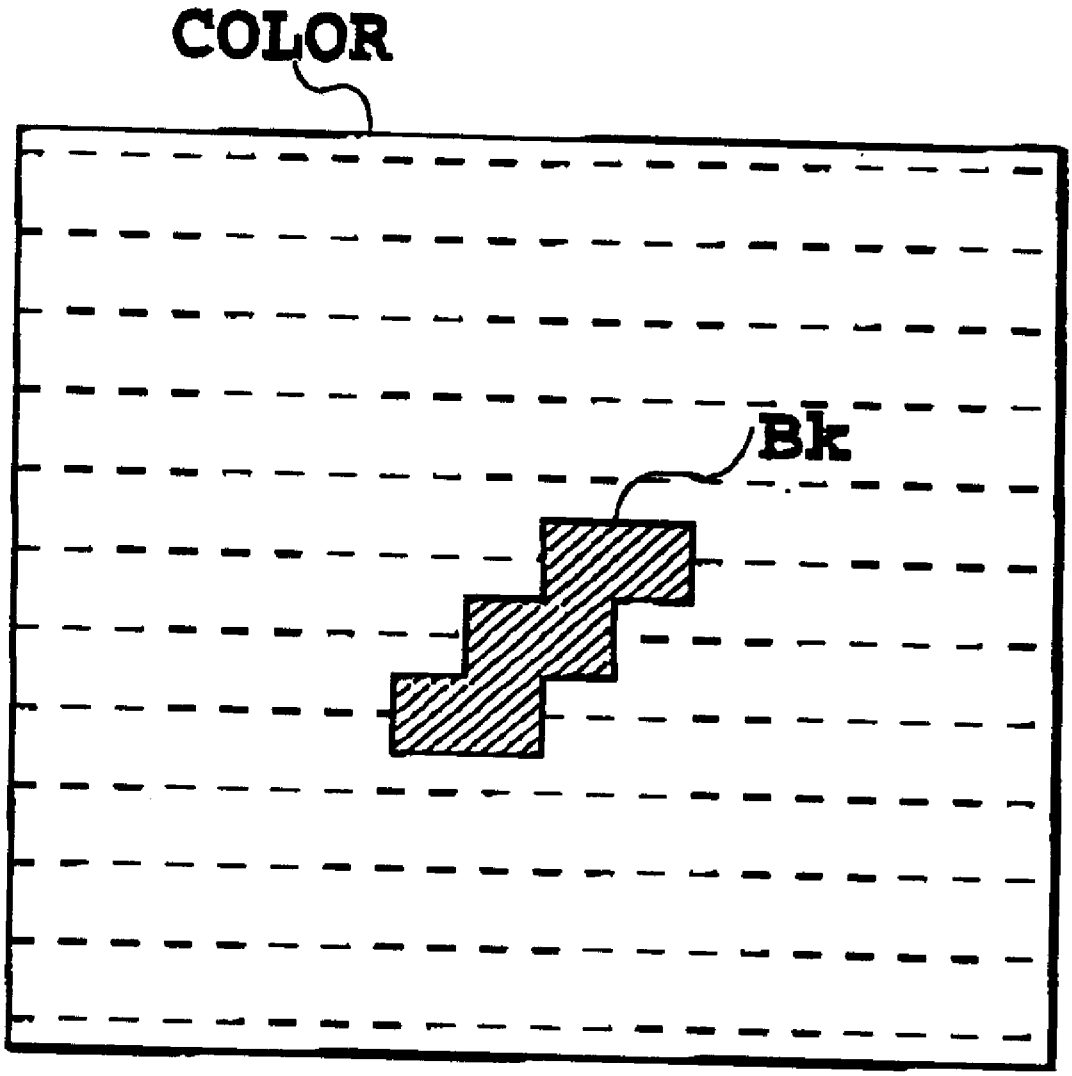
FIG. 1 is a diagram schematically showing an example of an image in which area printed with black ink and the area printed with color inks are mixed.

As shown in FIG. 1, in the case of printing an image in which a color area is present around a black (Bk) area, Bk ink, which permeates at a low speed, is first applied to a printing medium, a processing liquid is then applied thereto, and a color ink (one of a cyan (C), a magenta (M) and a yellow (Y) inks, or a combination of two or more color inks) is finally applied thereto. In this case, the processing liquid is given both to the Bk ink and to the color ink so as to achieve the above-described effect of the processing liquid on the overall image. More specifically, in printing the image with areas of the Bk and color inks mixed therein, the processing liquid is at once applied to the Bk and color ink areas, that is, the overall image.

In this printing, the Bk ink may bleed around the black area, that is, at a vicinity of a boundary between the black ink area and the color ink area. The embodiment of the present invention effectively reduces or prevents this bleeding.

Figure 2A:
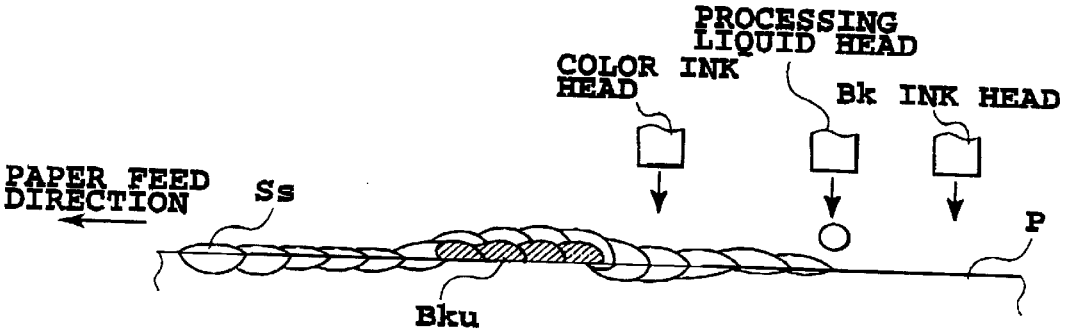
FIGS. 2A, 2B and 2C are diagrams for describing bleeding between a black image and a color image in a conventional example.
Figure 2B:
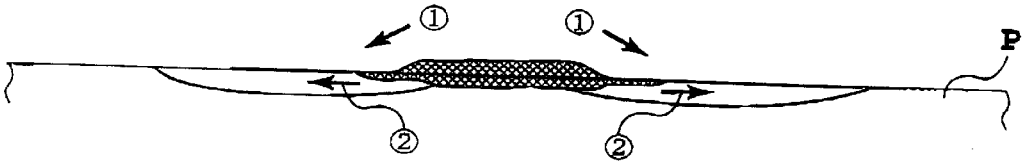
Figure 2C:
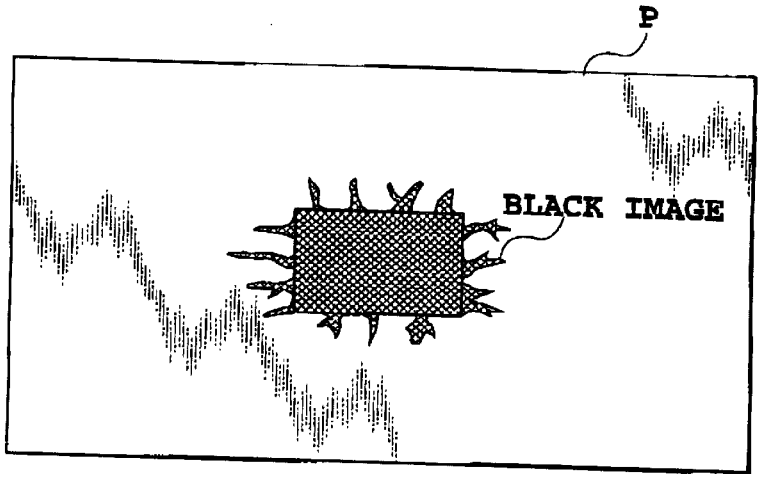

FIGS. 2A, 2B and 2C are diagrams for describing such bleeding. In these Figures, illustration of a color ink image is omitted.

Results of the examinations by the inventors indicate that the black ink may bleed in a form of whiskers as shown in FIG. 2C to some degree upon the application of the processing liquid following the application of the Bk ink. This is because a portion of the image where the processing liquid overlaps the Bk ink is thicker than an adjacent portion with the processing liquid only, so that upon reaction between the Bk ink and the processing liquid, a liquid flows from thicker to thinner portion, that is, from higher to lower liquid level. In particular, when the Bk ink and the processing liquid react at a relatively low speed, the Bk ink is assumed to flow out more extensively. Additionally, in an actual printing operation, the ink ejected from a head as well as the paper has relative horizontal speed components, whereby it is also assumed that the ink is likely to flow in the corresponding direction.

Furthermore, when using the processing liquid which is highly permeable, that is, when using the processing liquid having high fixing speed per se, the above-described bleeding becomes more significant.

As shown in FIG. 2A, the processing liquid is applied to a range of pixels from pixels to which the Bk ink Bku is applied to pixels to which the color inks are applied. Thus, a reactant between the previously applied Bk ink Bku and the processing liquid or the Bk ink Bku is fluidized so that a part of the Bk image collapses like an avalanche, as an arrow ① shown in FIG. 2B. At this point of time, as shown in FIG. 2C, the processing liquid has already permeated through the periphery of the black image due to its high permeability, so that the reactant or the ink collapsed as described above flows over a surface layer portion of the paper as an arrow ② shown in FIG. 2B. Then, along the passage of the flow, the reactant or the ink flows into the periphery of the image. As a result, bleeding in the form of whiskers occurs.

As described above, the bleeding, which is undesirable for the quality of image, may occur in an image with black and color images mixed therein. As is apparent from the above description, such a phenomenon occurs because pixels of the Bk ink and pixels of color inks are adjacent to each other and the processing liquid is applied to all of these pixels. That is, the processing liquid forms around the black area a passage, which extends over a wide range and through which the reactant or the ink flows.

Figure 3A:
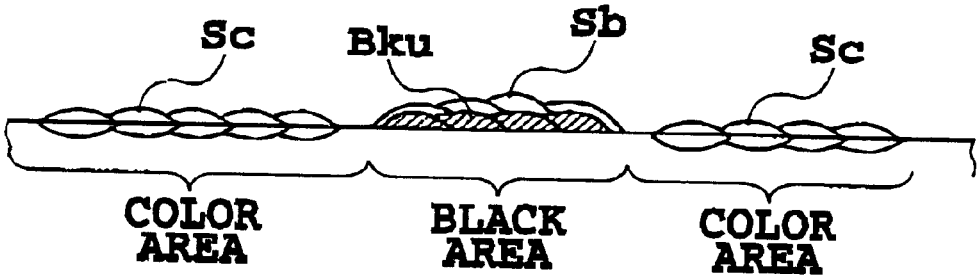
FIGS. 3A, 3B and 3C are diagrams for describing how the bleeding at the boundary described above is reduced according to an embodiment of the present invention.
Figure 3B:
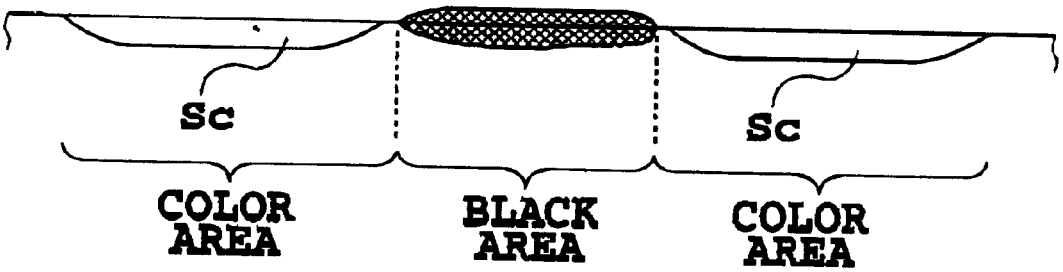
Figure 3C:
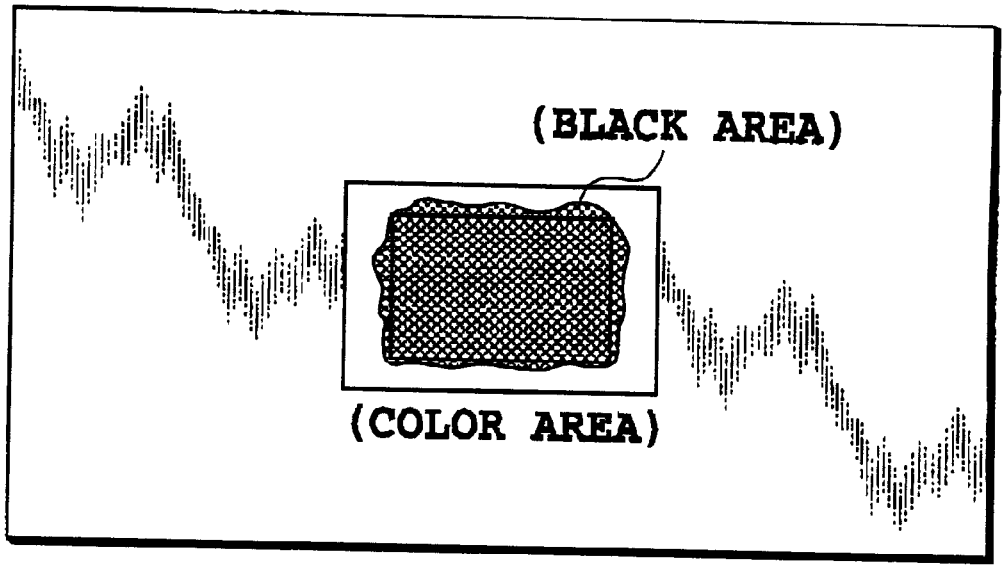

In this embodiment, as shown in FIGS. 3A to 3C, the processing liquid is not applied to a boundary portion between the black and color areas of the image to be printed so that the processing liquid is discontinued. In this case, the processing liquid is not applied to those portions of the image around the black area to which the color ink is applied. Thus, the bleeding at the boundaries can be prevented, while the processing liquid is applied to all of the black area, thereby enabling black characters or the like having high density to be printed without feathering. Additionally, it is true that there are potions of the color area to which the processing liquid is not applied, but almost all of this color area is covered with the processing liquid so that the image can be provided with a sufficient water resistance.

In this embodiment, the Bk ink is of the remaining upper part-type. As shown in FIG. 3A, the Bk ink Bku is applied to the printing medium and then the processing liquid Sb is applied to the Bk ink in an overlapping manner, so that the printing for the black area is performed. On the other hand, as to the color areas, the processing liquid is applied to the periphery of the black area before applying the color inks but not at the boundary portion between the color area and the black area, as shown in FIG. 3A.

The black image printed by means of the above method has sharp edges without bleeding in the form of whiskers, as shown in FIGS. 3B and 3C, and at the same time the overall black image has sufficient water resistance.

Preferably, use of a processing liquid of relatively high permeability improves the fixing capability of the Bk ink. More preferably, increasing the permeability of the color inks can improve the fixing capability of the color inks per se to realize generally fast printing.

Embodiments will be explained based on the above described examinations.

Embodiment 1

Figure 4:
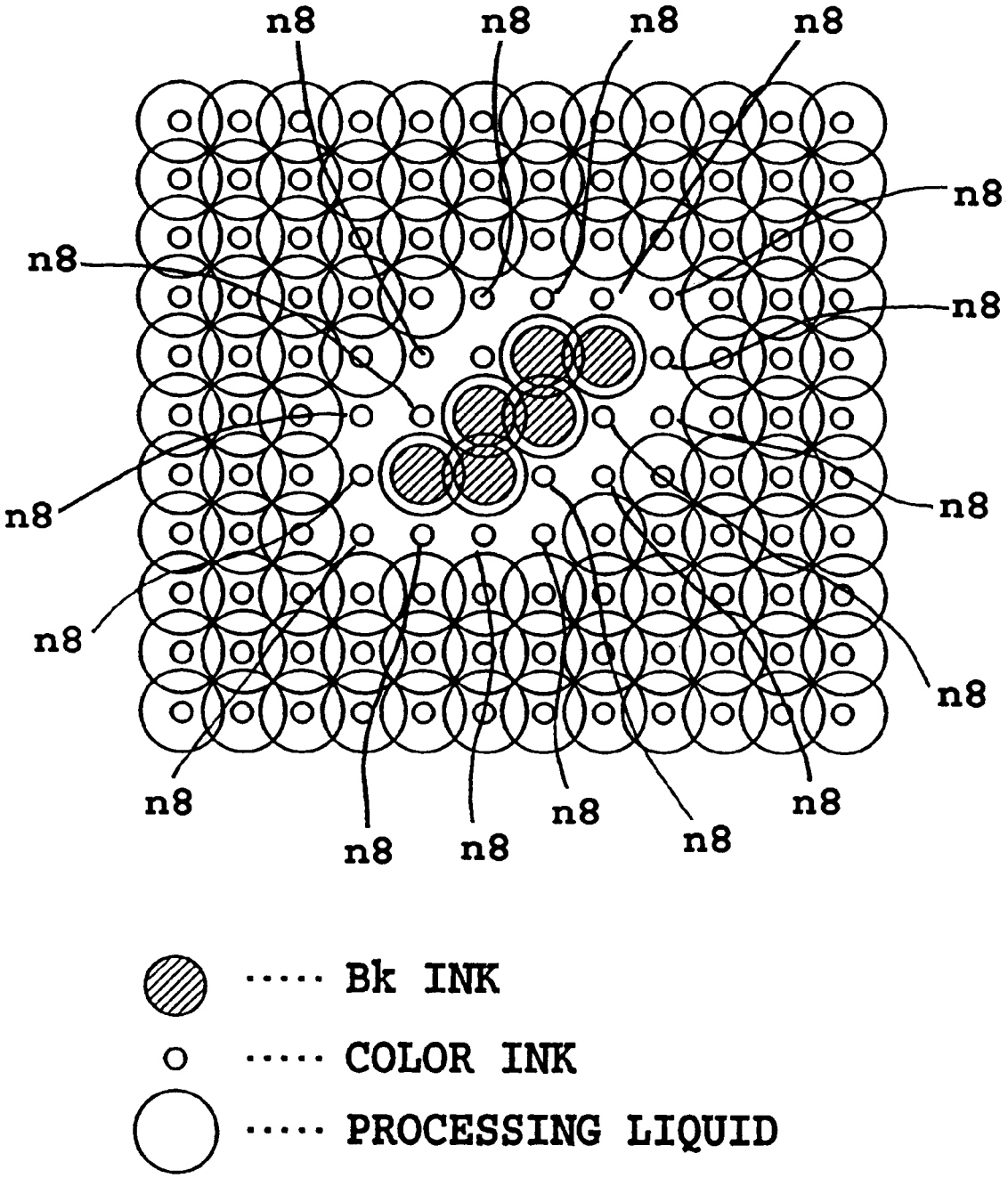
FIG. 4 is a diagram for explaining a printing method according to a first embodiment of the present invention.

FIG. 4 is a diagram schematically showing image data according to a first embodiment of the present invention. As shown in this figure, for the ejection data of the Bk ink, ejection data of the processing liquid is identical to ejection data of the Bk ink. That is, these data are such that the Bk ink and the processing liquid are ejected on what is called a dot-on-dot basis. On the other hand, when color image data indicative of ejection of a combination of Y, M, and C inks is present around the black area and in the pixels adjacent thereto, data for the pixels which are located in eight neighborhoods of the Bk data area have data indicative of avoidance of the ejection of the processing liquid.

In this case, the "eight neighborhood pixels" are located over and under the pixels with the black ink applied thereto, to the right and left thereof, and diagonally thereof. In FIGS. 4–8, an eight neighborhood pixel is denoted by the reference sign n8.

In addition, in FIG. 4, the inks and the processing liquid are shown as dots shown by circles of respective predetermined sizes, and each of the dots for the inks and processing liquid has an area factor of 100% for the corresponding pixel, that is, an overall pixel area is filled with the corresponding ink or the processing liquid.

As described above, according to this embodiment, when an image with a black and a color mixed therein is printed, processing liquid ejection data for the black and color is basically in accordance with black and color ejection data, respectively. Accordingly, in the case that black and color ejection data is continuously present over contiguous pixels, respectively, that is, in the case that the black and color images are solid images, respectively, the processing liquid ejection data is also continuously present over respective areas of contiguous pixels. However, the processing liquid ejection data is not continuous at a boundary portion between the area of black contiguous pixels and the area of color contiguous pixels. As a result, a black character or the like having sharp edges can be printed with high fixing capability and the bleeding at the boundary between the black of the black character and the color areas around the black area can be appropriately decreased. Furthermore, as described above, the data indicates that the processing liquid is not applied to the pixels of the color ink in the eight neighborhoods of the black pixel, but the color inks of the eight neighborhood pixels can come in contact with the processing liquid applied to the adjacent color pixels, thereby, providing the color ink at these pixels with a predetermined effect such as the water resistance, at some degree.

In this embodiment, the inks and the liquid are ejected in the order of the Bk ink, the processing liquid, and the color inks. The color inks can be ejected in an arbitrary order, for example, in the order of C, M, and Y. The order in which the Bk ink, the processing liquid, and the color inks are ejected is not limited to the above-described example. It may be such that the reaction between the Bk ink and the processing liquid is not affected by the application of the color inks, and for example, the color inks may be applied before applying the Bk ink and processing liquid. Further, an applying order that the processing liquid is applied before the Bk ink is applied may be used as one applying order of the Bk ink and the processing liquid. Also, this configuration can be applied to other embodiments described below.

Embodiment 2

Figure 5:
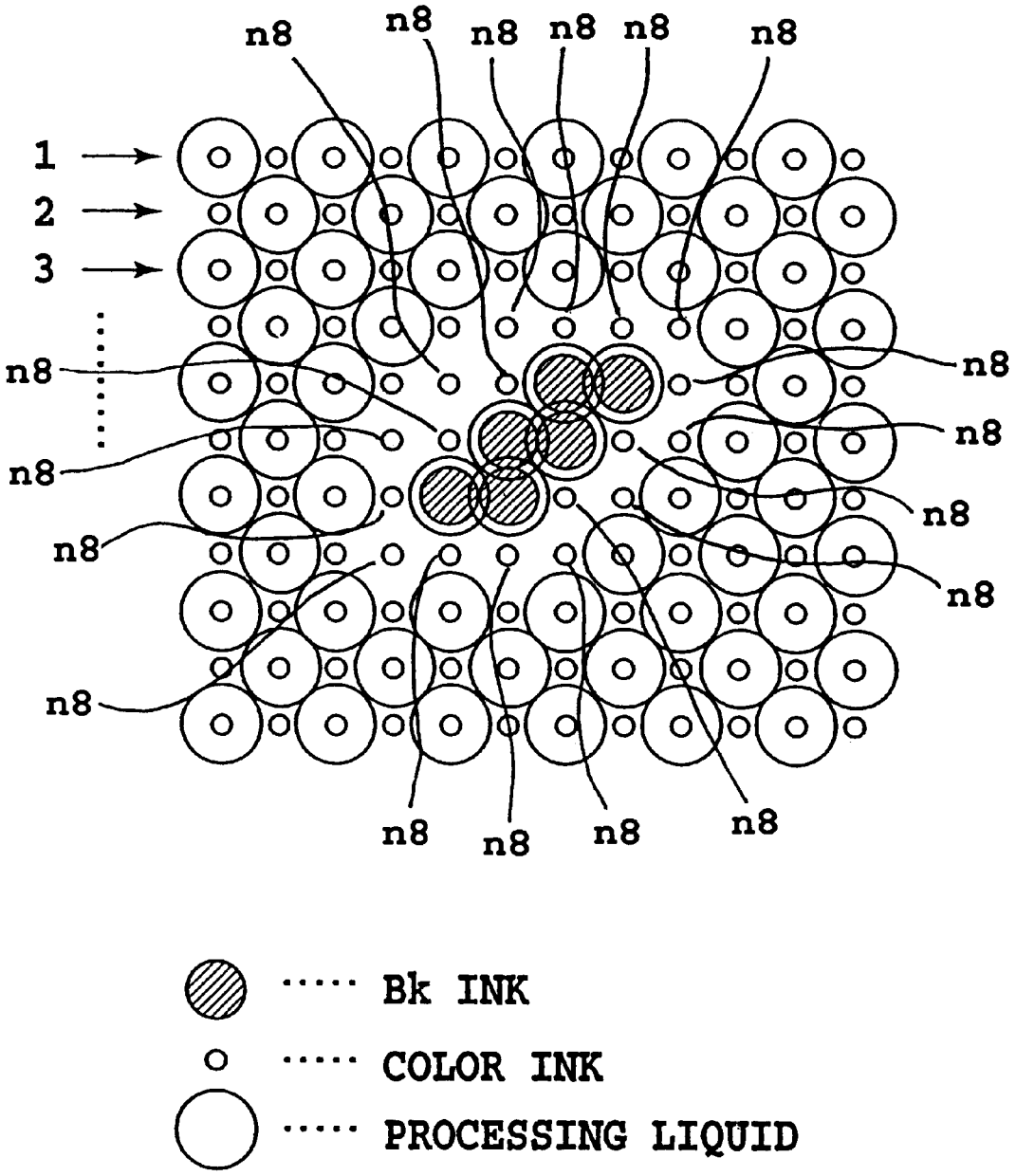
FIG. 5 is a diagram for explaining a printing method according to a second embodiment of the present invention.

This embodiment is similar to Embodiment 1 in terms of processing liquid data for the Bk ink but differs therefrom in that processing liquid data for the color inks is thinned with a checker pattern to become ½ ejection data. FIG. 5 is a diagram schematically showing such ejection data.

A method for generating the processing liquid ejection data shown in FIG. 5 is explained below. To generate the processing liquid ejection data, previously obtained ejection data for the black and color inks are in a pixel arrangement shown in FIG. 5 sequentially scanned from a most left pixel toward a right in a top line 1. Once this line has been scanned, the process proceeds to the next line 2 and similarly the data is scanned. This process is repeated to generate the processing liquid ejection data for the overall image. In this data generating procedure, for the color data, the processing liquid data is generated with the checker pattern for the color inks ejection data. On the other hand, for the black data, the processing liquid ejection data is generated on the dot-on-dot basis. Furthermore, no processing liquid ejection data is generated for the pixels of color inks and the pixels in the eight neighborhoods of the pixels of black ink.

According to this embodiment, as in Embodiment 1, a high-quality black image can be printed with little feathering as well as with high fixing capability of the inks realized. In addition, despite thinning of the processing liquid ejection data to half, the color ink at the boundary portion is appropriately provided with predetermined effects by the processing liquid such as water resistance, as in Embodiment 1.

Embodiment 3

Figure 6:
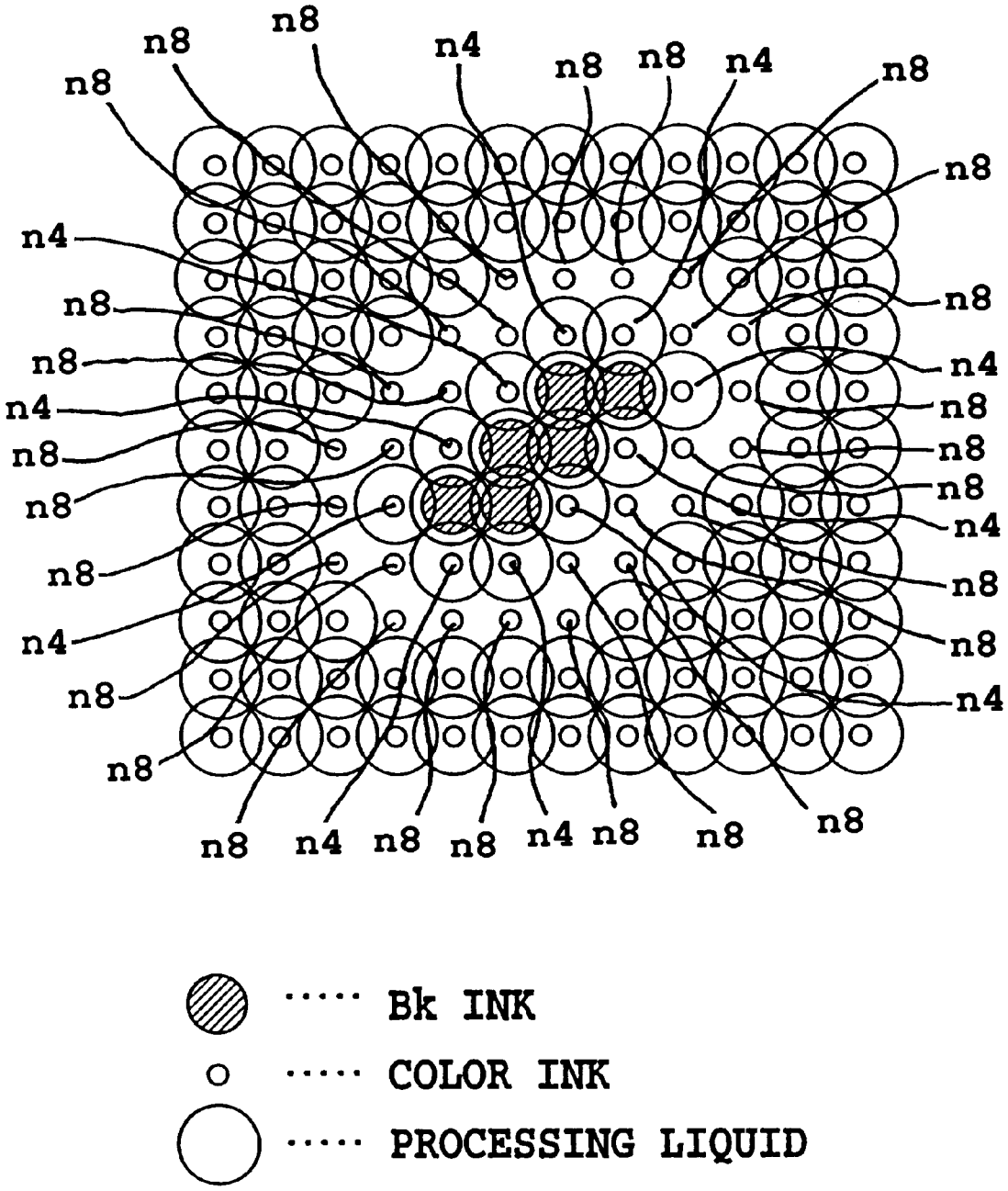
FIG. 6 is a diagram for explaining a printing method according to a third embodiment of the present invention.

This embodiment is similar to the above-described embodiments in that the processing ejection liquid is applied to the Bk ink on the dot-on-dot basis, but differs therefrom in that the processing liquid ejection data for the black area is such that the processing liquid is also applied to the pixels in the four neighborhoods of the pixel of the black (pixels located over and under the pixel of black area and to the right and left thereof), as shown in FIG. 6. In FIGS. 4–8, a four neighborhood pixel is denoted by the reference sign n4. This edge emphasis process prevents relatively well the above-described avalanche-like flow of the reactant when the Bk ink and the processing liquid react there between, thereby providing sharper images.

The processing liquid ejection data for the color inks is such that no processing liquid ejection data is provided for the pixels in the eight neighborhoods of the four-neighborhood pixels correspondingly to the addition of the processing liquid ejection data for the four-neighborhood pixels. The processing liquid data corresponding to the color data for the other areas are formed on the dot-on-dot basis.

Embodiment 4

Figure 7:
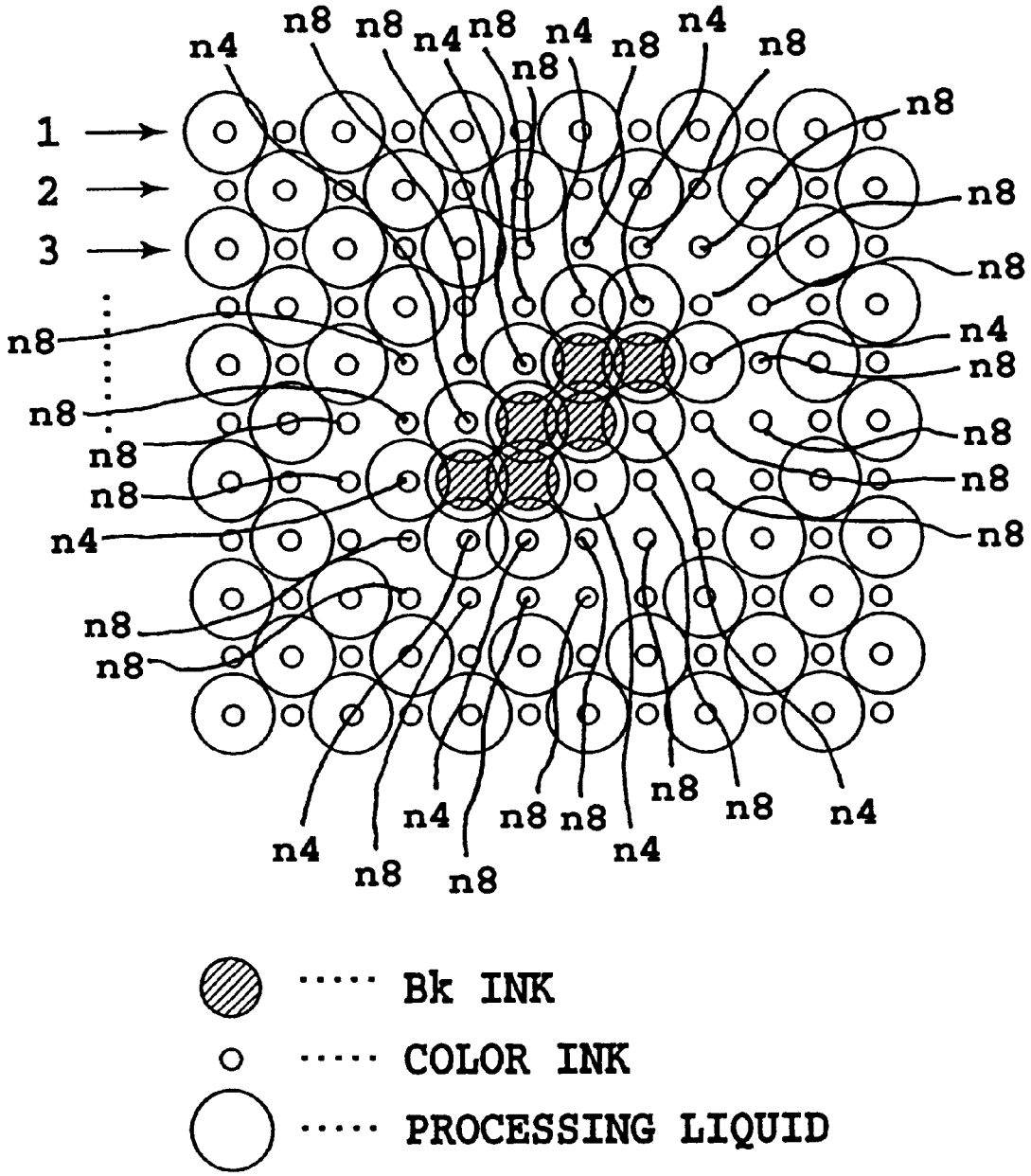
FIG. 7 is a diagram for explaining a printing method according to a fourth embodiment of the present invention.

According to this embodiment, in the printing method of Embodiment 3, the processing liquid data for the color ink is thinned to half. FIG. 7 is a diagram schematically showing an example of such image data. A method for generating the processing liquid ejection data according to this embodiment is similar to that described in Embodiment 2 with reference to FIG. 5, but differs therefrom in the following points. For the Bk ink data, the processing liquid data is generated on the dot-on-dot basis, and is also generated for the four-neighborhood pixels of the pixel of the Bk ink. In addition, no processing liquid data is generated for the color ink data corresponding to the pixels in the eight neighborhoods of the each of the four neighborhood pixels.

This embodiment provides effects similar to those of the above-described embodiments.

Embodiment 5

Figure 8:
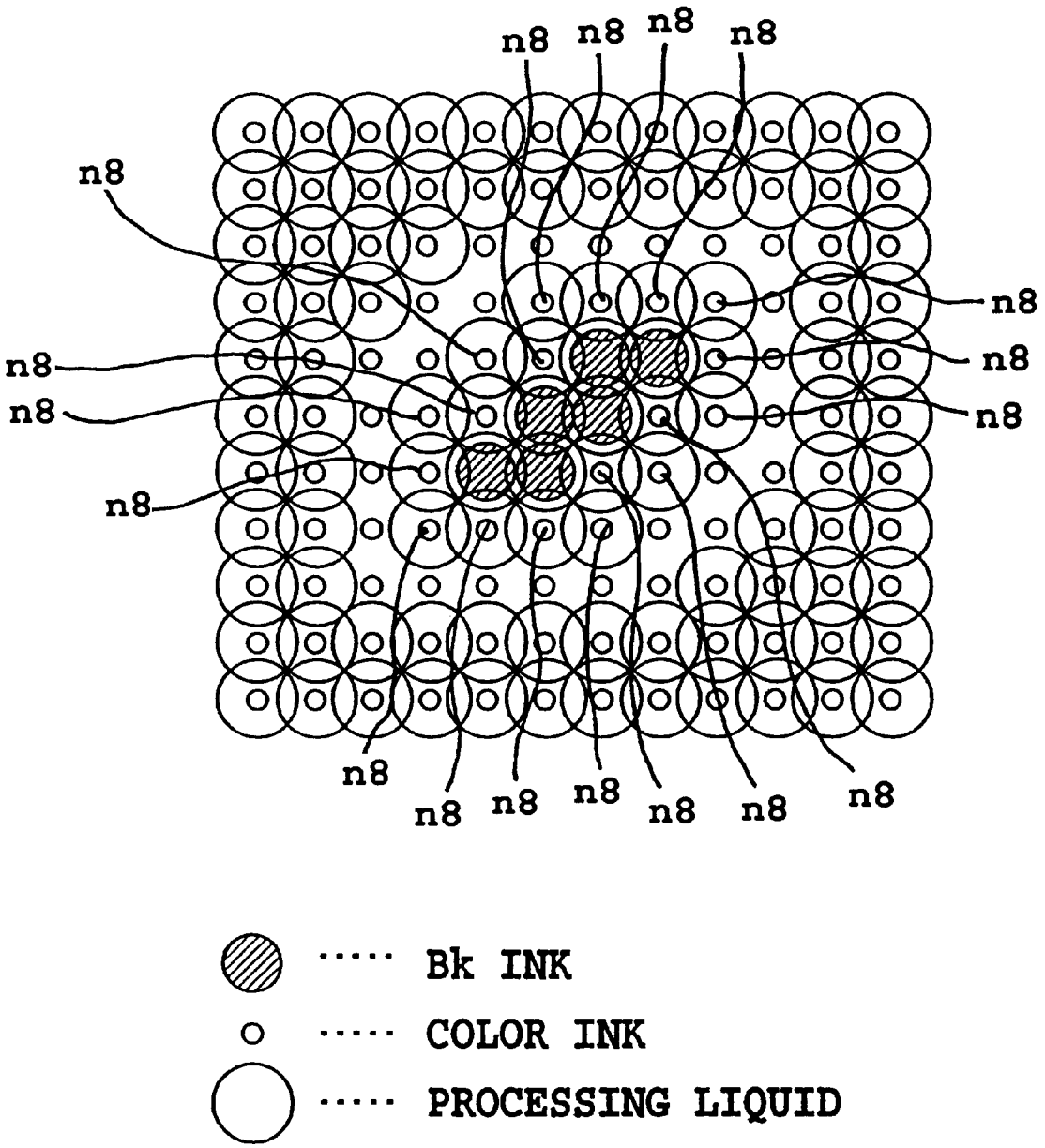
FIG. 8 is a diagram for explaining a printing method according to a fifth embodiment of the present invention.

According to this embodiment, as shown in FIG. 8, when applied to the black area, the processing liquid is applied to the eight neighborhoods of this area, compared to the four neighborhoods in Embodiment 4. The other steps for generating processing liquid application data are similar to those of the above-described embodiments. This embodiment also enables edge emphasis as in Embodiment 4 and provides predetermined effects such as bleeding prevention.

Specific examples

Specific examples of the above-described embodiments will be described below with reference to the drawings.

Figure 9:
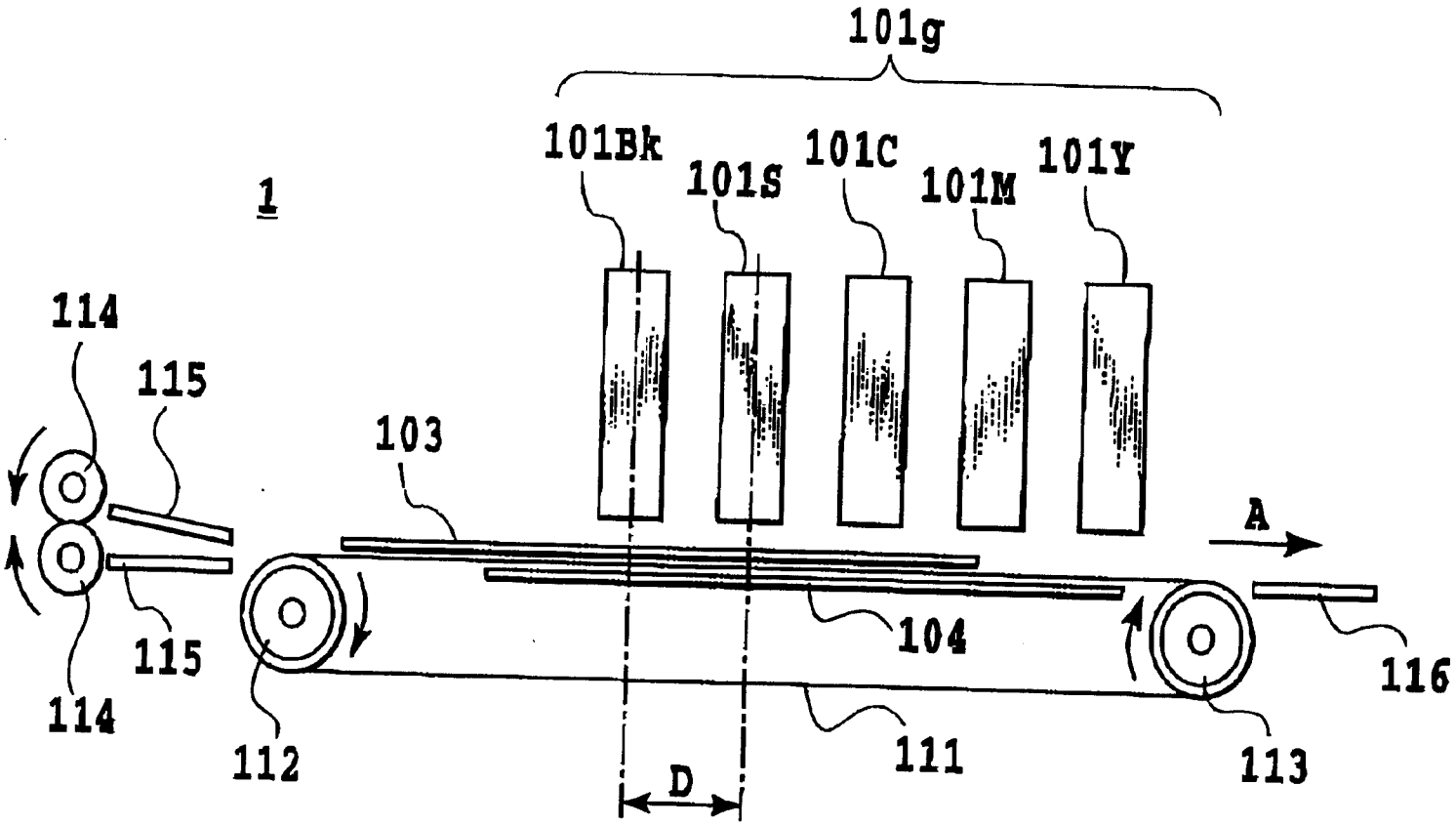
FIG. 9 is a side view showing a general configuration of a printer according to an embodiment of the present invention.

FIG. 9 is a schematic diagram showing a general configuration of a full-line type printing apparatus according to one example of the present invention.

The printing apparatus 1 employs an ink jet printing method of ejecting inks or a processing liquid from a plurality of full-line type print heads located at predetermined positions along a direction (direction shown by an arrow A in the figure) in which printing paper as a printing medium is fed. The printing apparatus 1 operates under the control of a control circuit (not shown).

Print heads 101Bk, 101S, 101C, 101M, and 101Y in a head group 101*g* are of the full-line type described above and each has about 7,200 ink ejection openings arranged in a cross direction (that is perpendicular to the sheet of the drawing) of the printing paper, which is fed in direction A in the figure. Accordingly, these heads enable printing on the printing paper of an A3 size at maximum.

The printing paper 103 is fed in direction A when a pair of resist rollers 114 driven by rotation of a feed motor. The printing paper is guided by a pair of guide plates 115 so as to have its tip registered and is then fed by a conveying belt 111. The conveying belt 111, an endless belt, is held by two rollers 112, 113, and vertical displacement of its upper part is regulated by a platen 104. Rotative driving of the roller 113 causes the printing paper to be conveyed. The printing paper 103 is electrostatically attracted to the conveying belt 111. The roller 113 is rotatively driven by a drive source such as a motor (not shown) in a direction that allows the printing paper 103 to be conveyed in direction A. The printing paper 103 is conveyed on the conveying belt 111 while having images printed thereon by the print head group 101*g*, and is then discharged onto a stocker 116.

Each print head of the print head group 101*g* uses thermal energy to produce a bubble in the ink or the liquid so that pressure of the bubble causes the ink or the liquid to be ejected. The print head group 101*g* has a head 101Bk for ejecting the black (Bk) ink described in the above embodiments and a processing liquid head 101S for ejecting the processing liquid also described in the above embodiments, and further has color ink heads (a cyan head 101C, a magenta head 101M, and an yellow head 101Y) arranged along direction A in which the printing paper 103 is conveyed, as illustrated. The print heads eject the corresponding inks and the processing liquid to enable black characters and color images to be printed.

In this example, the black ink ejected from the head 101 Bk has a low permeation speed (such an ink is called as the "remaining upper part-type ink" in this example), whereas the processing liquid and cyan, magenta, and yellow inks ejected from the heads 101S, 101C, 101M, 101Y, respectively have a high permeation speed (such liquid or inks are called as a "highly-permeable inks" in this example).

The permeation speed will be described in brief.

When the permeability of the processing liquid or the ink (hereafter simply referred to as a "liquid") is represented, for example, by volume V per 1 $m^2$, the liquid permeation volume V (in milliliter/$m^2$=$\mu$m) measured as an amount after elapsing time t from ejection of liquid droplets is expressed by the Bristow equation as shown below.

$$V=Vr+Ka(t-tw)^{1/2}$$

where t>tw.

Immediately after the droplets have been landed onto a surface of the printing paper, most of them are absorbed by asperities on the surface (rough portions on the surface of the printing paper) and prevented from permeating through the printing paper. In this case, an amount of time tw (wet time) passes and a volume Vr of the liquid during the time tw is absorbed by the asperities. When the amount of time that has passed after the landing of the droplets exceeds tw, the permeation volume V increases in proportion to the half power of the excess time (t−tw). The above-described Ka is a proportion factor for this increase and corresponds to the permeation speed.

Figure 10:
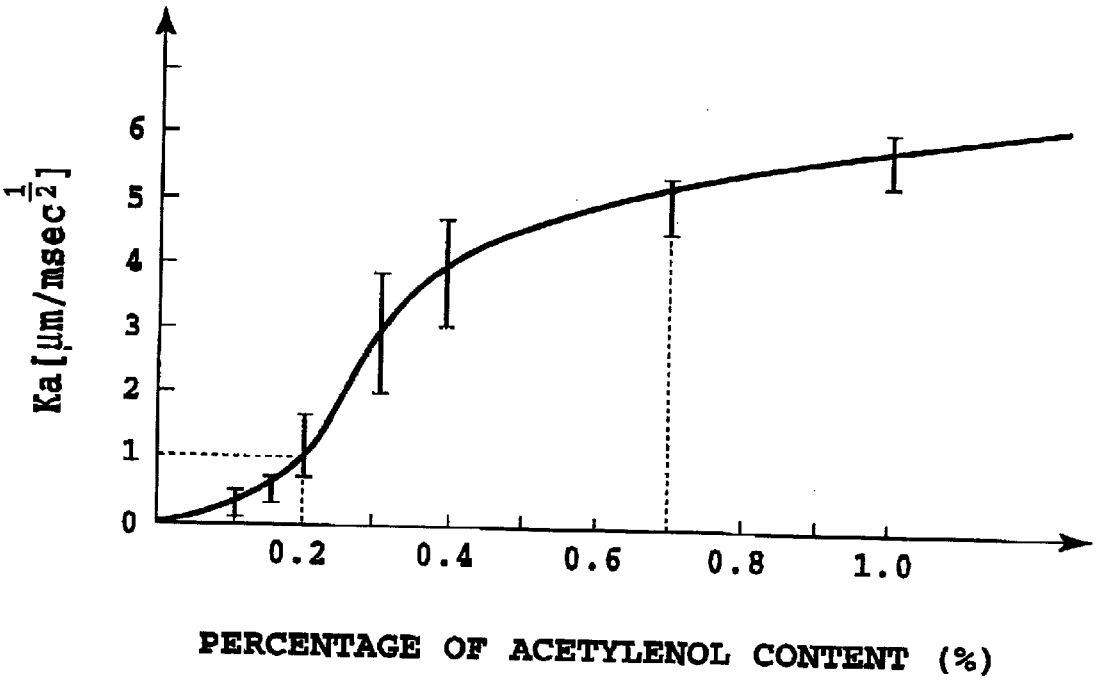
FIG. 10 is a chart showing a relationship between a rate of an acetylenol content and a Ka value concerning permeability, according to the embodiment.

FIG. 10 is a chart showing values of the proportion factor Ka with respect to a rate of acetylenol contained in the liquid as experimentally determined.

The Ka value was measured using a dynamic liquid permeability testing device (manufactured by Toyo Precision Machine Manufacturing Company) based on the Bristow method. This experiment used PB paper from Canon Inc., which is the applicant, as the printing paper. The PB paper can be used both for copiers and LBPs (laser beam printers) using the electro-photographic system and for printers using the ink jet printing system.

Similar results were obtained using PPC paper that is electro-photographic paper available from Canon Inc.

The curve shown in FIG. 10 indicates that the Ka value (shown by an ordinate) increases linearly with increase of the rate of acetylenol content (shown by an abscissa). The proportion factor Ka depends on the rate of acetylenol content. Thus, the ink permeation speed is substantially determined by the rate of acetylenol content. Segments extending parallel with the axis of the ordinate in a fashion crossing the curve indicate ranges of variations in measurement results.

Figure 11A:
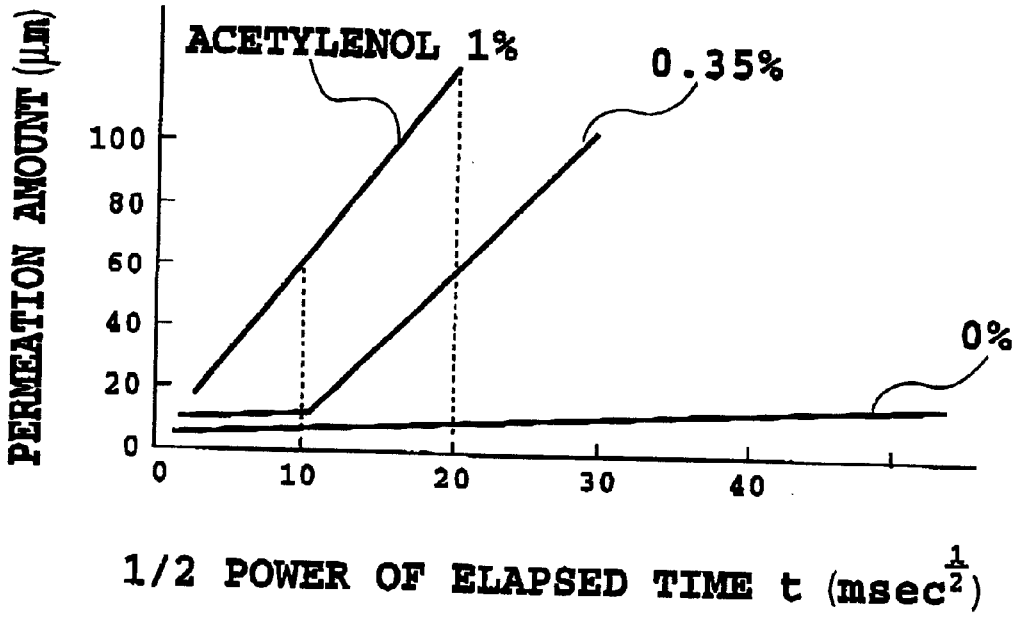
FIGS. 11A and 11B are charts showing relationships between a permeation amount and an elapsed time after landing or hitting of a liquid on a medium, wherein the rate of the acetylenol content concerning permeability is shown as a parameter.
Figure 11B:
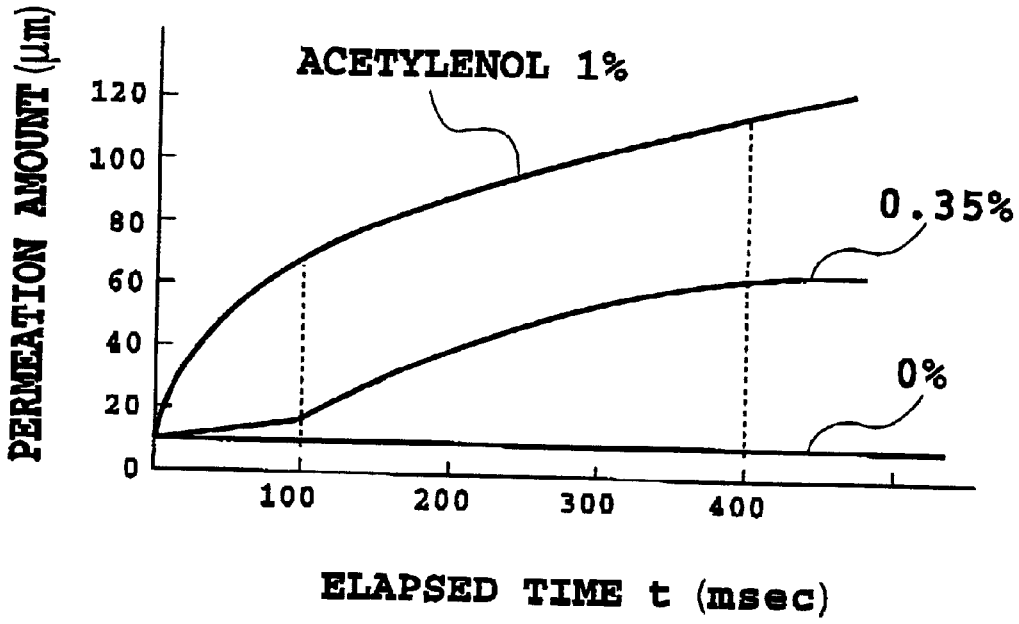

FIGS. 11A and 11B are characteristic diagrams showing the ink permeation volume plotted as a function of the elapsed time; this graph shows results of experiments using the printing paper (PB paper) described above, which was 64 g/m$^2$, 80 $\mu$m in thickness, and about 50% in void percentage.

In FIG. 11A, an abscissa indicates a value of the half power of the elapsed time (msec$^{1/2}$), whereas in FIG. 11B, an abscissa indicates the elapsed time t (msec). In both figures, ordinates indicate the permeation volume V ($\mu$m) and the curves indicate the rate of acetylenol content varied between 0 and 0.35 and 1%, respectively.

As is apparent from both figures, the greater the rate of acetylenol content is, the greater the ink permeation volume is with respect to the elapsed time, indicating a higher permeability. The graphs shown in FIGS. 11A and 11B indicate that the wet time tw decreases with an increase in acetylenol content and that the permeability increases linearly with the rate of acetylenol content even before the time tw is reached.

In addition, a liquid free from acetylenol (the acetylenol content is 0%) has a low permeability and exhibits the characteristics of the remaining upper part-type ink, which will be defined later. Additionally, when the liquid has 1% of acetylenol content, it permeates through the printing paper 103 at a high speed and exhibits the characteristics of the highly-permeable ink, which will be defined later. An ink with 0.35% of acetylenol content exhibits the characteristics of a semi-permeable ink, which is an intermediate between the remaining upper part-type ink and the highly-permeable ink.

Table 1 shows the characteristics of the "remaining upper part-type ink" and "highly-permeable ink" described above and of the "semi-permeable ink", which is an intermediate between these inks.

TABLE 1

| | Ka value (ml/m$^2$ · msec$^{1/2}$) | Acetylenol content (%) | Surface tension (dyne/cm) |
|---|---|---|---|
| Remaining upper part-type ink | Less than 1.0 | Less than 0.2 | 40 or more |
| Semi-permeable ink | 1.0 or more and less than 5.0 | 0.2 or more and less than 0.7 | 35 or more and less than 40 |
| Highly-permeable ink | 5.0 or more | 0.7 or more | Less than 35 |

The above Table 1 shows the Ka value, acetylenol content (%), and surface tension (dyne/cm) of each of the "remaining upper part-type ink", the "semi-permeable ink", and the "highly-permeable ink". The permeability of each ink on the printing paper as a printing medium increases consistently with increasing of the Ka value. That is, it increases when surface tension decreases.

The Ka value in Table 1 was measured using the dynamic liquid permeability testing device (manufactured by Toyo Seiki Seisaku-Sho, Ltd.) based on the Bristow method as described above. This experiment used PB paper from Canon Inc., which is the applicant, as the printing paper. Additionally, similar results were obtained using PPC paper that is electrophotographic paper also available from Canon Inc.

One of the conditions known for mixture of a surfactant into a certain liquid is a critical micelle concentration (CMC) of the surfactant in this liquid. The critical micelle concentration refers to an increased concentration of a solution of the surfactant at which dozens of molecules are associated rapidly with one another to form micelles. The acetylenol, which is contained in the liquid described above to adjust the permeability, is a type of surfactant that has a critical micelle concentration depending on the liquid.

A relationship between the CMC and the surface tension achieved when the acetylenol content is adjusted is such that the surface tension stops decreasing when micelles are formed. Thus, the critical micelle concentration (CMC) of acetylenol in water has been confirmed to be about 0.7%.

A comparison between the critical micelle concentration shown in this figure and the Table 1 above indicates that, for example, the "highly-permeable ink" defined in Table 1 has a acetylenol content larger than the critical micelle concentration (CMC) of acetylenol in water.

The compositions of the processing liquid and inks used in this example are shown below. The rate of each component is shown in terms of parts by weight.

| | |
|---|---|
| [Processing liquid] | |
| Glycerin | 7 pts. wt. |
| Diethylene glycol | 5 pts. wt. |
| Acetylenol EH (manufactured by Kawaken Fine Chemicals Co., Ltd.) | 2 pts. wt. |
| Polyallylamine | 4 pts. wt. |
| Acetic acid | 4 pts. wt. |
| Benzalkonium chloride | 0.5 pts. wt. |
| Water | Remaining part |
| [Yellow (Y) ink] | |
| C.I. direct yellow 86 | 3 pts. wt. |
| Glycerin | 5 pts. wt. |
| Diethylene glycol | 5 pts. wt. |
| Acetylenol EH (manufactured by Kawaken Fine Chemicals Co., Ltd.) | 1 pts. wt. |
| Water | Remaining part |
| [Magenta (M) ink] | |
| C.I. acid red 289 | 3 pts. wt. |
| Glycerin | 5 pts. wt. |
| Diethylene glycol | 5 pts. wt. |
| Acetylenol EH (manufactured by Kawaken Fine Chemicals Co., Ltd.) | 1 pts. wt. |
| Water | Remaining part |
| [Cyan (M) ink] | |
| C.I. direct blue 199 | 3 pts. wt. |
| Glycerin | 5 pts. wt. |
| Diethylene glycol | 5 pts. wt. |
| Acetylenol EH (manufactured by Kawaken Fine Chemicals Co., Ltd.) | 1 pts. wt. |
| Water | Remaining part |
| [Black (M) ink] | |
| Pigment dispersing agent | 25 pts. wt. |
| Food black | 2 pts. wt. |
| Glycerin | 6 pts. wt. |
| Triethylene glycol | 5 pts. wt |
| Acetylenol EH (manufactured by Kawaken Fine Chemicals Co., Ltd.) | 0.2 pts. wt. |
| Water | Remaining part |

The above pigment dispersing agents will be described below.

Pigment dispersing agents

A solution was prepared by dissolving 5 g of thick hydrochloric acid in 5.3 g of water, and 1.58 g of anthranilic acid was added to this solution at 5° C. The solution was maintained at 10° C. or lower by means of agitation in an ice bath, and was then mixed with a solution prepared by adding 1.78 g of sodium nitrite to 8.7 g of water at 5° C. Further, after 15 minutes of agitation, 20 g of carbon black having a surface area of 320 $m^2/g$ and a DBP oil absorption of 120 ml/100 g was added to the mixture. Subsequently, the mixture was further agitated for 15 minutes. A slurry thus obtained was filtered using Toyo Filter Paper No.2 (manufactured by Advantec), pigment particles were washed off, and the slurry was dried in an oven at 110° C. Water was added to this pigment to produce an aqueous solution of pigment containing 10 wt. % of pigment. The above method was used to obtain the pigment dispersing agent containing an anionically charged self-dispersing carbon black having a hydrophilic radical bound thereto via phenyl group as shown in a formula below.

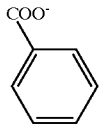

As is apparent from the above compositions, by adjusting the acetylenol content, the black ink is set to be of the remaining upper part-type and the processing liquid and the C, M, and Y inks are set to be of the highly-permeable type.

In addition, the black ink is, what is called, a dispersing agent-free pigment, which has been described in the above example. With this ink, a self-dispersing carbon black dispersant having at least one type of hydrophilic radical bound to a surface thereof directly or via another atomic group is preferably used as the anionic carbon black dispersant. Additionally, the self-dispersing carbon black is preferably ionic and more preferably anionically charged.

In the anionically-charged carbon black, the hydrophilic radical bound to the surface may be, for example, —COOM, $—SO_3M$, $—PO_3HM$, $—PO_3M_2$, $—SO_2NH_2$, or $—SO_2NHOR$ (where M denotes hydrogen atom, alkali metal, ammonium, or organic ammonium, and R denotes an alkyl group with a carbon atom number of 1 to 12, a phenyl radical that may have a substituent, or a naphthyl radical that may have a substituent). In this embodiment, an anionically-charged carbon black having —COOM or $—SO_3M$ bound to its surface is preferable.

Additionally, for the "M" in the hydrophilic radical, the alkali metal may be, for example, lithium, sodium, or potassium, and the organic ammonium may be mono- or tri-methyl ammonium, mono- or tri-ethyl ammonium, or mono- or tri-methanol ammonium. To obtain the anionically-charged carbon black, —COONa may be introduced into the carbon black surface by, for example, oxidizing the carbon black with sodium hypochlorite. Of course, however, the present invention is not limited to this method.

In this embodiment, the carbon black with the hydrophilic radical bound to its surface via another atomic group is preferable. The another atomic group may be, for example, an alkyl group with a carbon atom number of 1 to 12, a phenyl radical that may have a substituent, or a naphthyl radical that may have a substituent). Specific examples of the hydrophilic radical bound to the carbon black surface via the another atomic group include, for example, $—CH_4COOM$, $—PhSO_3M$, and —PhCOOM (where Ph denotes a phenyl surface) in addition to those listed above. Of course, the present invention is not limited to these examples.

This dispersing agent-free carbon black is superior to conventional carbon blacks and thus does not require the addition of a pigment dispersing resin or a surfactant. Thus, advantageously, this carbon black is appropriately fixed and wetted and can be reliably used for print heads, compared to conventional pigments.

In this example, each print head has the ink ejection openings arranged therein at a density of 600 dpi and carries out printing at a dot density of 600 dpi in the printing paper feed direction. Accordingly, images or the like printed according to this embodiment have a dot density of 600 dpi both in the row direction and in the column direction. In addition, each head has an ejection frequency of 4 kHz, so that the printing paper is fed at about 170 mm/sec. Furthermore, since a distance D between the Bk ink head 101Bk and the processing liquid head 101S (see FIG. 9) is 40 mm, the time from the Bk ink ejection until the processing liquid ejection is therefor about 0.24 sec.

Furthermore, 80% of the particles in the self-dispersing pigment used in this embodiment preferably have a particle size between 0.05 and 0.3 $\mu$m, and more preferably between 0.1 and 0.25 $\mu$m.

Figure 12:
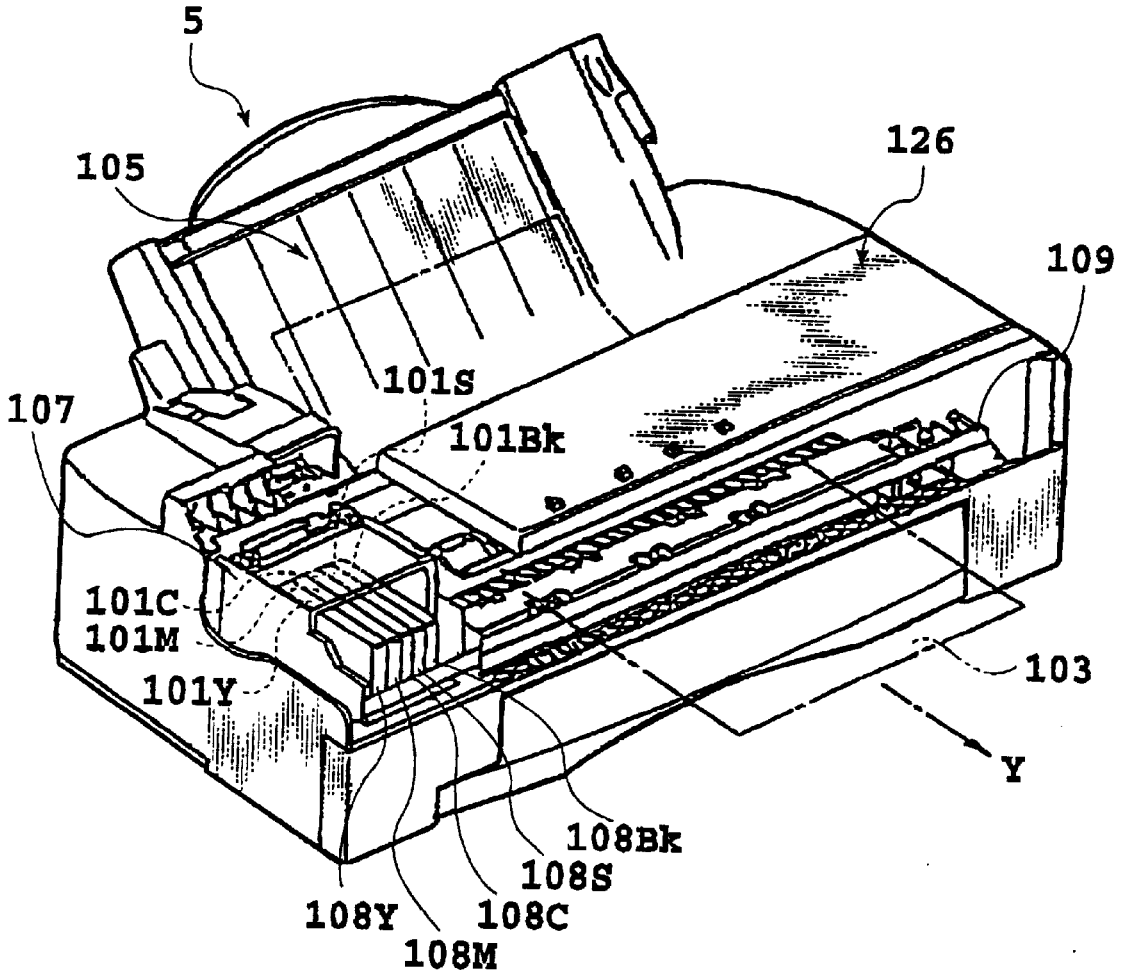
FIG. 12 is a perspective view showing a serial printer according to another embodiment of the present invention.

FIG. 12 is a schematic perspective view showing the configuration of a serial printing apparatus 5 according to another example of the present invention. Clearly, the printing apparatus applying the Bk ink to the printing medium and then ejecting the processing liquid for reaction is applicable not only to the above-described full-line type but also to the serial type. The same elements as shown in FIG. 9 carry the same reference numerals and detailed description thereof is omitted.

The printing paper 103, which is the printing medium, is inserted from a paper feed section 105 and discharged through a printing section 126. In this example, common inexpensive plain paper is used as the printing paper 103. In the printing section 126, a carriage 107 mounts the print heads 101S, 101Bk, 101C, 101M, and 101Y and is adapted to reciprocate along a guide rail 109 based on a driving force applied by a motor (not shown). The print head 101S can eject the processing liquid described above in the embodiments. In addition, the black head 101Bk and the heads 101C, 101M, 101Y eject the black ink, the cyan ink, the magenta ink, and the yellow ink, respectively. These heads are driven so that after the black ink and then the processing liquid are ejected, the remaining inks are ejected onto the printing paper 103 in the above order.

Each head is supplied with the processing liquid or the corresponding ink from an ink tank 108Bk, 108S, 108C, 108M, 108Y. For ink ejection, a drive signal is supplied to an electro-thermal converting element (heaters) provided for each the ejection opening of each head to apply thermal energy to the ink or the processing liquid in order to generate bubbles, whereby pressure provided upon bubbling is used to eject the ink or the processing liquid. Each head has 64 ejection openings arranged at a density of 360 dpi in a direction almost the same as a direction Y in which the printing paper 103 is fed, that is, a direction substantially perpendicular to a head scanning direction. And an amount of the inks or the processing liquid ejected from each ejection opening realizes any of the embodiments described above.

In the above configuration, the respective distance between the heads are 1 inch, so that the distance between the heads 101Bk and 101S is 1 inch. Additionally, the print density in the scanning direction is 720 dpi, and the ejection frequency of each head is 7.2 kHz. Accordingly, the time from the Bk ink ejection from the head 101 Bk until the processing liquid ejection from the head 101S is 0.05 sec.

As apparent from above description with respect to the embodiments and examples of the embodiments, according to the above embodiments, in the case of using the processing liquid together with a black and color inks to print an image, in which an image area printed with the black ink and an image area printed with the color ink are mixed, an application of the inks and the processing liquid is controlled so that the respective processing liquid applied to each of the areas of black and inks will not be connected with each other on the printing medium. Consequently, the respective processing liquid can be present within the boundary between the area of the black ink and the area of the color inks, whereby reactants between the Bk ink and the processing liquid are prevented from flowing out to the area of color inks. As a result of this, reducing the bleeding at the boundaries between the area of black ink and the area of color inks can be realized.

As a result, black characters or the like can be printed with high density and little feathering as well as with high fixing capability, and image can be printed with little bleeding at the boundaries between a black image such as a black character and a color image.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

What is claimed is:

1. An ink jet printing method of performing printing by applying to a printing medium, an ink and a processing liquid for making a coloring material in the ink insoluble, said method comprising the step of:

applying the processing liquid to respective areas of the printing medium to which a black ink containing a black coloring material and a color ink are applied, respectively, wherein the processing liquid is applied for each of the respective areas so that none of the respective processing liquids come in contact with one another on the printing medium.

2. An ink jet printing method as claimed in claim 1, wherein the respective areas to which the black ink and the color ink are applied respectively are formed from a plurality of pixels and the black and the color inks are applied to the plurality of pixels, respectively.

3. An ink jet printing method as claimed in claim 2, wherein the processing liquid is not applied to a predetermined pixel among the plurality of pixels to which the color inks are applied so that the respective processing liquids do not come in contact with one another.

4. An ink jet printing method as claimed in claim 3, wherein the predetermined pixel is adjacent to a boundary between the respective areas to which the black ink and the color ink are applied, respectively.

5. An ink jet printing method as claimed in claim 3, wherein the predetermined pixel is separated from a boundary between the respective areas, to which the black ink and the color ink are applied, respectively, by one or more pixels for the color ink and by one or more pixels to which the processing liquids are applied.

6. An ink jet printing method as claimed in claim 2, wherein to respective plurality of pixels of the respective areas, the black ink and the color inks are continuously applied, respectively.

7. An ink jet printing method as claimed in claim 2, wherein to pixels obtained by thinning the respective plurality of pixels of the respective areas, the black ink and the color inks are applied, respectively.

8. An ink jet printing method as claimed in claim 1, wherein the color ink is applied to the printing medium after the black ink and the processing liquid are applied.

9. An ink jet printing method as claimed in claim 1, wherein the processing liquid has higher permeability to the printing medium than the black ink has.

10. An ink jet printing method as claimed in claim 9, wherein the color ink has higher permeability to the printing medium than the black ink has.

11. An ink jet printing method as claimed in claim 10, wherein the black ink is anionic and the processing liquid has a cationic polymer material.

12. An ink jet printing method as claimed in claim 11, wherein the processing liquid has a nonionic surfactant as a material for facilitating permeation.

13. An ink jet printing method as claimed in claim 1, wherein the black ink is applied to the printing medium before the processing liquid is applied.

14. An ink jet printing method as claimed in claim 1, wherein the processing liquid is applied to the printing medium before the black ink is applied.

15. An ink jet apparatus for performing printing by applying to a printing medium, an ink and a processing liquid for making a coloring material in the ink insoluble, said apparatus comprising:

(a) means for applying a black ink and color ink to the printing medium; and (b) means for applying a processing liquid to respective areas of the printing medium to which the black ink containing a black coloring material and the color ink are applied, respectively, the respective areas having a boundary between the areas, wherein the processing liquid is applied to each of the respective areas such that none of the respective processing liquids are in contact with one another on the printing medium.

16. An ink jet printing apparatus as claimed in claim 15, wherein the respective areas to which the black ink and the color ink are applied respectively are formed from a plurality of pixels and the black and the color inks are applied to the plurality of pixels, respectively.

17. An ink jet printing apparatus as claimed in claim 16, wherein the processing liquid is not applied to a predetermined pixel among the plurality of pixels to which the color inks are applied so that the respective processing liquids do not come in contact with one another.

18. An ink jet printing apparatus as claimed in claim 17, wherein the predetermined pixel is adjacent to a boundary between the respective areas to which the black ink and the color ink are applied, respectively.

19. An ink jet printing apparatus as claimed in claim 17, wherein the predetermined pixel is separated from a boundary between the respective areas, to which the black ink and the color ink are applied, respectively, by one or more pixels for the color ink and by one or more pixels to which the processing liquids are applied.

20. An ink jet printing apparatus as claimed in claim 16, wherein the black ink and the color inks are continuously applied to the plurality of pixels of the respective areas, respectively.

21. An ink jet apparatus as claimed in claim 16, wherein the black ink and the color inks are applied to pixels obtained by thinning the plurality of pixels of the respective areas, respectively.

22. An ink jet printing apparatus as claimed in claim 15, wherein the color ink is applied to the printing medium after the black ink and the processing liquid are applied.

23. An ink jet printing apparatus as claimed in claim 15, wherein the processing liquid has higher permeability to the printing medium than the black ink.

24. An ink jet printing apparatus as claimed in claim 23, wherein the color ink has higher permeability to the printing medium than the black ink.

25. An ink jet printing apparatus as claimed in claim 24, wherein the black ink is anionic and the processing liquid has a cationic polymer material.

26. An ink jet printing apparatus as claimed in claim 25, wherein the processing liquid has a nonionic surfactant as a material for facilitating permeation.

27. An ink jet printing apparatus as claimed in claim 15, wherein the black ink is applied to the printing medium before the processing liquid is applied.

28. An ink jet printing apparatus as claimed in claim 15, wherein the processing liquid is applied to the printing medium before the black ink is applied.

29. A data generating method of generating processing liquid application data for application of processing liquid, said data being used in a printing apparatus which applies black ink, color ink and the processing liquid for making respective coloring materials in the black and color inks insoluble to a printing medium to perform printing, said method comprising the step of:

generating processing liquid application data to control application of the processing liquid (i) to a first area to which the black ink is applied and a second area to which the color ink is applied, (ii) but not to a portion of the second area adjacent to a boundary between the first area and the second area.

30. A printing apparatus comprising:

(a) means for applying black ink, color ink and a processing liquid for making respective coloring materials in the black and color inks insoluble to a printing medium, to perform printing; and (b) means for generating processing liquid application data to control application of processing liquid to a first black area to which the black ink is applied and a second area to which the color ink is applied, but not to a portion of the second area adjacent to a boundary between the first area and the second area.

31. A program for a data generating process present on a medium containing code for generating processing liquid application data for application of a processing liquid, and said data being used in a printing apparatus which applies black ink, color ink and the processing liquid for making respective coloring materials in the black and color inks insoluble to a printing medium to perform printing, said process comprising:

generating processing liquid application data to control application of processing liquid to a first area to which the black ink is applied and a second area to which the color ink is applied, but not to a portion of the second area adjacent to a boundary between the first area and the second area.

32. A control program present on a medium containing code to control a process of performing printing by applying to a printing medium, ink and a processing liquid for making a coloring material in the ink insoluble, said process comprising:

applying the processing liquid to respective areas of the printing medium to which a black ink containing a black coloring material and color ink are applied, respectively, wherein the processing liquid is applied to each of the respective areas so that none of the respective processing liquids come in contact with one another on the printing medium.

* * * * *

UNITED STATES PATENT AND TRADEMARK OFFICE

CERTIFICATE OF CORRECTION

PATENT NO. : 6,474,778 B1
DATED : November 5, 2002
INVENTOR(S) : Noribumi Koitabashi et al.

It is certified that error appears in the above-identified patent and that said Letters Patent is hereby corrected as shown below:

Column 7,
Line 7, “there between” should read -- therebetween --.

Column 11,
Line 58, “substituent).” should read -- substituent. --.

Column 14,
Line 61, “ink jet apparatus” should read -- ink jet printing apparatus --.

Signed and Sealed this

Nineteenth Day of August, 2003

JAMES E. ROGAN
*Director of the United States Patent and Trademark Office*